United States Patent [19]

Wilkins et al.

[11] Patent Number: 4,709,630

[45] Date of Patent: Dec. 1, 1987

[54] PRINTING WHEEL SETTING AND ALIGNING APPARATUS

[75] Inventors: David R. G. Wilkins, Wistaston; Reginald D. Brooker, Leonard Stanley; Roger Walker, Nantwich; Harry Powell, Biddulph, all of England

[73] Assignee: McCorquodale Machine Systems Limited, Basingstoke, England

[21] Appl. No.: 8,086

[22] Filed: Jan. 21, 1987

Related U.S. Application Data

[63] Continuation of Ser. No. 780,712, Sep. 26, 1985, abandoned, which is a continuation of Ser. No. 76,807, Sep. 18, 1979, abandoned.

[51] Int. Cl.[4] ..... B41J 1/46

[52] U.S. Cl. ..... 101/93.22; 101/99; 101/110; 101/45

[58] Field of Search ..... 101/93.22, 45, 56, 99, 101/110, 96; 400/144.2

[56] References Cited

U.S. PATENT DOCUMENTS

| | | | |
|---|---|---|---|
| 3,141,403 | 7/1964 | Brown et al. | 101/99 |
| 3,363,547 | 1/1968 | Thut et al. | 101/110 X |
| 3,623,426 | 11/1971 | Gross | 101/45 |
| 3,683,801 | 8/1972 | Barrett | 101/99 |
| 3,707,214 | 12/1972 | Ponzano | 400/144.2 |
| 3,872,789 | 3/1975 | Ambrosio | 101/110 X |
| 4,050,375 | 9/1977 | Orlens | 101/110 |
| 4,055,118 | 10/1977 | Sato | 101/110 |
| 4,095,686 | 6/1978 | Okabe | 101/110 |

FOREIGN PATENT DOCUMENTS

| | | |
|---|---|---|
| 1037153 | 7/1966 | United Kingdom . |
| 1264693 | 2/1972 | United Kingdom . |
| 1289394 | 9/1972 | United Kingdom . |
| 1374162 | 11/1974 | United Kingdom . |

*Primary Examiner*—Edward M. Coven
*Attorney, Agent, or Firm*—Solon B. Kemon

[57] ABSTRACT

Apparatus for printing any line of characters comprises printing wheels on a common shaft, the wheels on the shaft together defining a printing line over a hammer. Each printing wheel is rotated by a respective stepping motor through a respective setting wheel. An aligner bar is inserted into notches in the wheels, prior to printing, to verify the alignment of the characters in printing position. The stepping motors are bi-directional and take the shortest path from a preceding printing position to the next printing position. The pulsing frequency may be ramped to give a higher stepping rate in the intermediate portion of each printing wheel movement.

4 Claims, 5 Drawing Figures

PRINTING WHEEL SETTING AND ALIGNING APPARATUS

This application is a continuation of application Ser. No. 780,712, filed 9/26/85, now abandoned, which is a continuation of application Ser. No. 076,807, filed Sept. 18, 1979, now abandoned.

This invention relates to the printing of lines of printed characters at high speed. Such high speed line printing has generally been carried out by means of a drum printer mechanism or a chain printer mechanism. In the drum printer a type drum rotates continuously and has type characters formed around its periphery in rows of identical characters across the drum and in columns extending around the periphery of the drum. An individual printing hammer is provided in alignment with each column. For each print position, the hammer is actuated at the instant that the required character in the aligned column of characters reaches the printing position. It will be appreciated that a very small error in timing of the actuation of a printing hammer will lead to a discrepancy in the alignment of the resulting printed character with other characters printed in the line.

The second form of line printer utilises a continuously moving type chain, moving in a direction parallel to the required line of print and individual hammers for each print position. Thus each character on the type chain moves over all print positions and the printing hammer for each position is actuated when the required character arrives at that position. The chain printer improves the horizontal alignment of printed characters but suffers from another form of defect since minor errors in timing lead to variations in space between the printed characters in a line. Both drum and chain printers suffer from the defect that the character element is moving when the hammer is actuated and this limits the print definition which can be obtained.

According to the present invention, a printing apparatus for printing a line of characters comprises at least two printing wheels having a common axis of rotation, each printing wheel having a set of type characters arranged around its periphery, and the apparatus defines a printing line containing a printing position for each printing wheel, the apparatus further comprising an individual stepping motor for each printing wheel for rotating that wheel to bring a selected character into the printing position. The stepping motor rotates the corresponding printing wheel in either direction and the apparatus includes means responsive to the existing rotary position of each printing wheel and to the wheel position at which a required character reaches the printing position, for determining the direction of rotation of the printing wheel to bring that character to the printing position most rapidly. This limits the required rotation to a maximum of 180° for any setting and permits a considerable reduction in the time required to set the printing wheel from one position to the next. In this preferred form, we provide a single alignment bar for all printing wheels and means operable when all printing wheels have been set to the required printing position to insert the common alignment bar into slots formed in the printing wheels. This damps out any residual "flutter" as the last wheels arrive at their correct positions, gives a final setting accuracy better than that achieved by each individual wheel setting and ensures good alignment of the line of characters printed by the printing wheels.

In order that the invention may be better understood, printing apparatus embodying the invention will now be described with reference to the accompanying drawings, in which:

FIG. I shows an arrangement of printing wheels and the driving means for the printing wheels;

Figure 1:
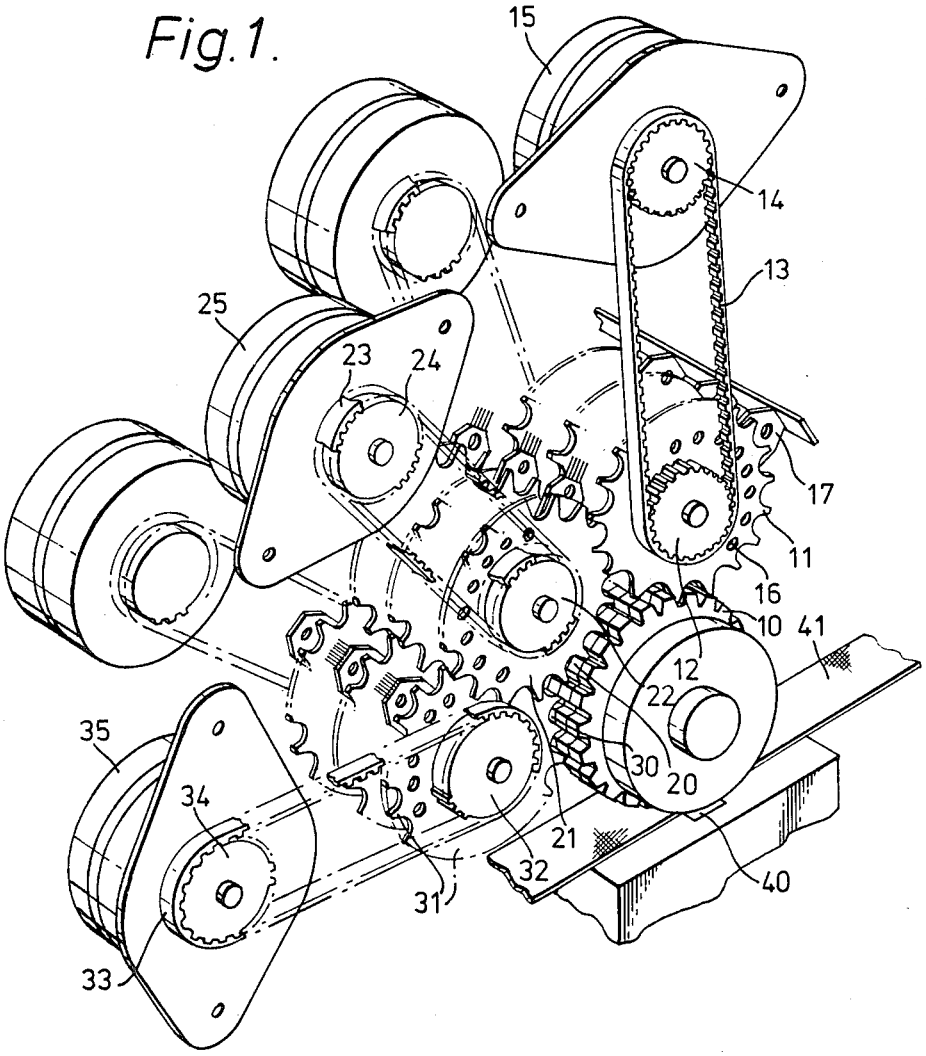

In FIG. 1, printing wheels 10, 20 and 30 having a common axis of rotation are rotated by setting wheels 11, 21 and 31 respectively. Toothed wheels 12, 22 and 32 are mounted on the shaft of and rotate with the setting wheels 11, 21 and 31. Toothed belts 13, 23 and 33 couple the wheels 12, 22 and 32 respectively with further toothed wheels 14, 24 and 34 mounted on the output shafts of stepping motors 15, 25 and 35.

As shown in the drawing, another bank of printing wheels, setting wheels, toothed belts and stepping motors is mounted behind the bank described above.

FIG. 1 also illustrates the printing hammer 40 and the ribbon 41.

As explained earlier, when the printing wheels have been set by the stepping motors, their alignment in the printing position is checked by the insertion of an alignment bar into slots formed in the printing wheels.

Figure 2:
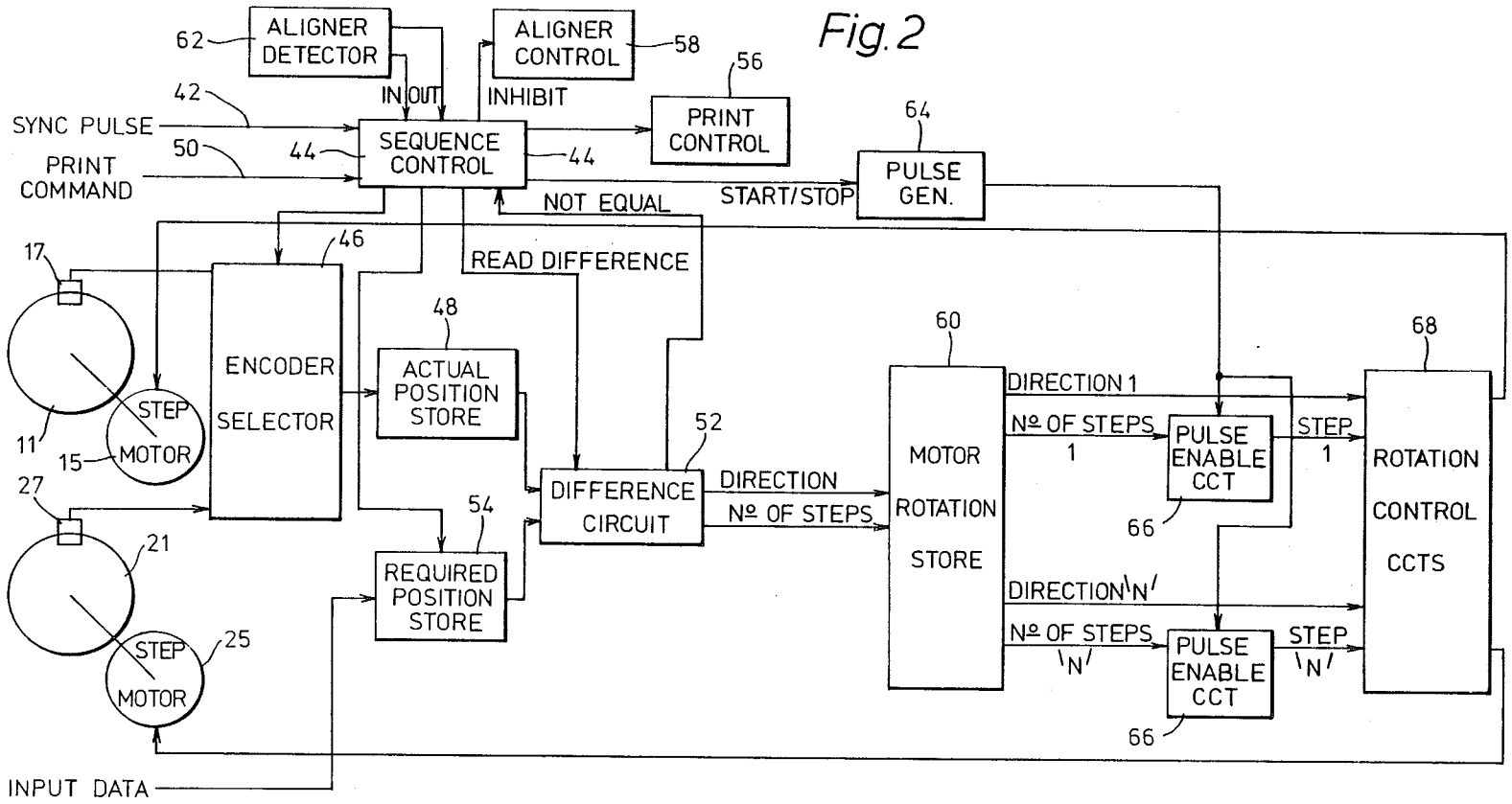
FIG. 2 is a block circuit diagram illustrating the operation of the apparatus shown in FIG. 1.

The operation of the printing apparatus described above is cyclically controlled. It will be described in connection with FIG. 2 from the point at which a synchronising pulse is fed to a sequence control circuit 44. At this point in the cycle, the printing wheels have just been set. In FIG. 2, for simplicity only wheels 11 and 21 are shown.

On receipt of the synchronising pulse over line 42, a sequence control circuit 44 instructs a selector 46 to connect a digital required position signal for each wheel in turn to a data store 48 constituting the "actual position" store. When all the data has been stored, the sequence control unit 44 checks the status of the "print command" signal on line 50. If the signal indicates that printing is not required in this cycle, no further action is taken. If the signal requires a print to be made, the sequence control unit applies a "read difference" signal to the difference circuit 52. The difference circuit 52 is connected both to the "actual position" store 48 and to a "required position" store 54, in which there is stored input data representing the required positions of the printing wheels. The difference circuit compares the actual and required positions for each wheel in turn. As each comparison is made, the sequence control circuit 44 monitors the "not equal" output of the difference circuit. If the sequence control detects a "not equal" signal at any time, it resets the print control unit 56 (to prevent printing) and applies an activating signal to the aligner bar inhibit control circuit 58, thereby preventing any attempt to insert the aligner bar into the printing wheels.

If, on the other hand, there is no "not equal" signal for any of the comparisons (indicating that all printing wheels are correctly set), then the sequence control unit 44 sets the print control 36 and deactivates the aligner bar inhibit control. In these circumstances, the aligner bar will be inserted into the notches in the printing wheels and, if correct insertion is detected, the print will take place. The sequence control unit 44 then issues a "read in new data" signal and this is applied to the "required position" store 54, causing the next input data to be read into the store.

Whichever course is followed (i.e. whether one or more wheels is found to be incorrectly set, or whether the wheels have been found to be correctly set and new data has been read in following a print), the sequence control circuit issues another "read difference" signal. As previously, the difference circuit compares the actual and required positions for each wheel and provides for each wheel an output corresponding to the direction of motion and an output corresponding to the number of steps in this direction required to bring the actual wheel position to the required wheel position.

These two outputs for each wheel are stored in the motor rotation store 60.

If the signal from the aligner bar status detector 62 indicates that the aligner bar is out, the sequence control circuit starts the pulse generator 64. The first pulse from this generator is fed to all the wheel pulse enable circuits 66. Those wheels requiring movement are enabled and the pulse is applied to the rotation control circuits 68. The direction of rotation is obtained by the circuits 68 directly from the store 60. As a result, the required motors move one step in the required direction, and drive each print wheel which is not in the required position through one step. On subsequent pulses, the pulse enable circuits 66 are under the control of the "number-of-steps" signal from store 60 for the wheel in question. For small movements, these circuits are enabled once in every five pulses from the pulse generator 64. This gives a fixed low speed stepping rate for wheels requiring small movements. For large movements, as will be explained with reference to FIG. 3 the circuits are enabled at variable lower ratios of the pulse generator frequency, allowing ramping up and down of the stepping rate in each movement for such wheels.

As the end of the time taken to move one wheel through 180° (i.e. through the maximum required movement) the sequence control circuit 44 stops the pulse generator 64. At this point, all wheels should be set to the required position. On receipt of the next synchronising pulse the cycle is repeated.

Figure 3:
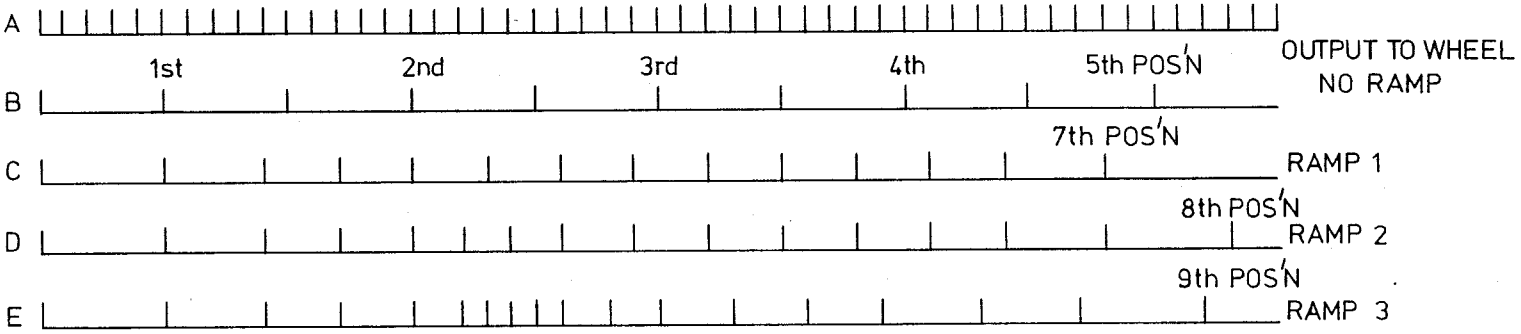
FIG. 3 shows pulse trains used for different degrees of rotation of the stepping motors.

In FIG. 3 the train of pulses from the generator 64 is indicated by the line A. FIG. 3 also indicates at B,C,D and E, the stepping pulses generated for four wheels requiring, respectively, movement to the fifth, seventh, eighth and ninth positions (from their existing positions). For movement to the fifth position (90°) no ramp is required and the stepping pulses are equidistantly spaced in time. In pulse trains C, D and E the stepping frequency increases after the initial wheel movement and then decreases again to the end of the wheel movement.

As each pulse is applied by the clock pulse generator 64 to pulse enable circuits 66 the rotation control circuit 68 determines whether at that point a stepping pulse is to be sent to any stepping motor. Thus, referring again to FIG. 5, on the fifth clock pulse after the initiating pulse a stepping pulse is sent to the stepping motors associated with pulse trains B, C, D and E. On the ninth clock pulse a stepping pulse is sent to the stepping motors associated with the pulse trains C, D and E and on the tenth clock pulse the stepping motor associated with train B receives a stepping pulse.

In this way all wheels are set within a predetermined period, whilst maintaining a maximum torque for each wheel throughout the stepping cycle.

Figure 4:
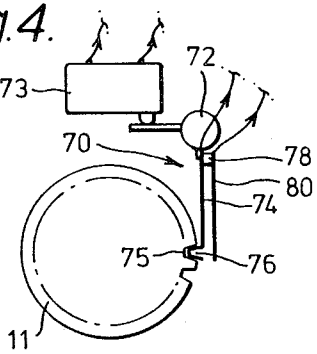
FIGS. 4 and 5 illustrate the alignment bar and switches associated therewith.
Figure 5:
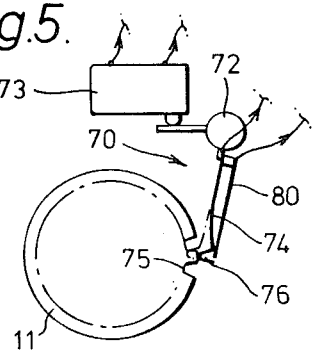

The operation at the aligner bar is illustrated in FIGS. 4 and 5. The aligner bar 70 is mounted to pivot an axis 72 and thereby to operate a microswitch 73, forming part of the aligner bar status detector. FIG. 4 shows the condition in which the aligner bar has fully entered the slots in all the printing wheels and the microswitch is closed.

In practice, the aligner bar 70 comprises a comb-like member 74, seen in edge view in the drawing, each tine of the comb carrying at its free end a tooth 76. Each tooth 76 registers with a different printing wheel. Behind the comb-like member 74 and separated therefrom by an insulator 78 is a conducting strip 80. FIG. 5 shows the condition in which all but one of the teeth has entered the corresponding printing wheel notch and the aligner bar has pivoted to close the microswitch. The single tine which has not entered a printing wheel notch rests on the periphery of its printing wheel and makes electrical contact with the strip 51. This tine and the strip 51 constitute a switch which indicates that full alignment has not been achieved in spite of the indication of the microswitch. Thus the microswitch indicates that the bar has been pivoted to its "in" position in a status-detection operation and the conductive strip switch detects the failure of one (or a small number) of printing wheels to achieve an aligned position.

Following a printing operation the paper and ribbon are stepped on.

Preferably a current sensing circuit is provided to monitor the current in each motor coil. When the motor receives a stepping pulse, the full supply voltage is applied to the motor coils but when the current has built up to the predetermined level set by the sensing circuit, a control signal from the sensing circuit prevents or limits any further increase in the motor drive current,. This enables a higher starting torque for each pulse and eliminates the need for series resistors in the motor coil leads, thereby reducing the heat generated in the apparatus.

With the construction illustrated in FIG. 1 the setting wheels and stepping motors may be mounted for lifting as a unit out of engagement with the print wheels.

We claim:

1. Printing apparatus for printing a line of characters comprising:

a plurality of toothed printing wheels having a common axis of rotation, each printing wheel having a set of type characters spaced around its periphery;

means defining a printing line, parallel to the said axis and containing a printing position for each printing wheel;

a plurality of setting wheels, one for each printing wheel, each setting wheel having a separate different axis of rotation and having teeth engaging in the spaces between the type faces of its printing wheel, the axes of rotation of the setting wheels being parallel to the said axis of the printing wheels and being arranged in an arc around the axis of the printing wheels;

a plurality of stepping motors, one for each printing wheel, each stepping motor having a driving shaft and a toothed wheel on the driving shaft, the axis of rotation of the stepping motors being spaced from one another about the axis of the printing wheels and being further than the setting wheel axes from the axis of the printing wheels;

a plurality of endless flexible transmission means, one coupling each stepping motor toothed wheel respectively to the corresponding setting wheel, whereby each stepping motor rotates the corresponding printing wheel to bring a selected character into the printing position;

an alignment bar having a portion for each printing wheel and being movable to cause each respective portion to engage in a slot in its printing wheel, such engagement of said portion and said slot being possible only if the corresponding printing wheel has a printing character in the printing position;

a print control means controlling the printing of a line of characters from the printing wheel; and switching means, responsive to the engagement of all said portions of said alignment bar in their respective printing wheel slots to supply to said print control means a signal indicative of the print wheel alignment.

2. Apparatus as defined by claim 1 in which said switching means is a micro switch.

3. Apparatus in accordance ith claim 1 in which the alignment bar is mounted for pivotal movement between first and second positions in which the switching means is respectively unoperated and operated, the alignment bar comprising a first member in the form of a comb having a resilient tooth for each printing wheel and a second member in the form of an elongate conductor having a portion behind and normally spaced from each tooth of the comb, whereby if during pivotal movement of the alignment bar from its first position the majority of its resilient teeth enter the respective printing-wheel slots, permitting the alignment bar to reach its second position, any resilient tooth which has failed to enter is printing-wheel slot will touch the portion of the elongate conductor located immediately behind that tooth to make an electrical contact indicating that full alignment has not been achieved.

4. Apparatus in accordance with claim 3, including sequencing means whereby if after the print wheel has been set and the insertion of the alignment bar into the print wheel slots has been tried, the switching means or the elongate conductor indicates that alignment has not been achieved, a further cycle of print wheel setting is carried out.

* * * * *